US006004177A

United States Patent [19]

Biesecker et al.

[11] Patent Number: 6,004,177

[45] **Date of Patent: *Dec. 21, 1999**

[54] POCKET-SIZED, EMERGENCY FLOTATION DEVICE WITH STATUS INDICATOR

[76] Inventors: Douglas A. Biesecker, 13 Addison Ct., Binghamton, N.Y. 13904; Bradley A. Biesecker, 1316 School St., Clarks Summit, Pa. 18411

[ * ] Notice: This patent is subject to a terminal disclaimer.

[21] Appl. No.: 09/132,555

[22] Filed: Aug. 11, 1998

Related U.S. Application Data

[63] Continuation-in-part of application No. 08/753,579, Nov. 26, 1996, Pat. No. 5,820,431, which is a continuation-in-part of application No. 08/655,651, May 30, 1996, Pat. No. 5,738,557.

[51] Int. Cl.[6] ..... B63C 9/18

[52] U.S. Cl. ..... 441/92; 441/106; 441/118

[58] Field of Search ..... 441/42, 88, 52, 441/53, 94, 106, 114, 115, 116, 117, 118, 119

[56] References Cited

U.S. PATENT DOCUMENTS

| | | | |
|---|---|---|---|
| 4,560,356 | 12/1985 | Burr | 441/80 |
| 4,666,413 | 5/1987 | Klein et al. | 441/92 |
| 5,098,325 | 3/1992 | Kim et al. | 441/88 |
| 5,511,998 | 4/1996 | Johnson | 441/56 |
| 5,738,557 | 4/1998 | Biesecker | 441/92 |
| 5,820,431 | 10/1998 | Biesecker et al. | 441/94 |

*Primary Examiner*—Sherman Basinger
*Attorney, Agent, or Firm*—Salzman & Levy

[57] ABSTRACT

The present invention features a pocket-sized, portable, flotation device that folds into a storage or carrying case, which is the size of a cellular phone. It can be carried upon a person in a shirt pocket or clipped to a waistline belt. The flotation device includes a life vest with a collar having separate cells, each of which is substantially sealed from adjacent cells to prevent deflation of the adjacent cells through puncture to one of the cells. The collar of the life vest inflates, cell by cell, allowing the user to position the vest over his or her head during inflation. The carrying case has a body and a detachable, arch-shaped cover, constructed so that a tether can be inserted into the cover and the device automatically activated by pulling the cover from the body. Moreover, the case includes a belt loop through which the belt of the user can be inserted. The handle can be hollow, to form a loop into which the tether (attached to the life vest itself) can be threaded. The handle can be adapted to receive a separate belt worn by the user or to receive a belt integral with the case itself. The case includes a window through which a user can visually determine the status of the device without removing same from its case. Alternatively, the entire case can be transparent.

10 Claims, 8 Drawing Sheets

POCKET-SIZED, EMERGENCY FLOTATION DEVICE WITH STATUS INDICATOR

RELATED APPLICATIONS

This application is a continuation-in-part of U.S. patent application Ser. No. 08/753,579, filed Nov. 26, 1996 for DEPLOYMENT MECHANISM FOR POCKET-SIZED, EMERGENCY FLOTATION DEVICE, assigned to the present assignee now U.S. Pat. No. 5,820,431, and which is a continuation-in-part of Ser. No. 08/655,651 filed May 30, 1996, now U.S. Pat. No. 5,738,557 for POCKET-SIZED, EMERGENCY FLOTATION DEVICE, hereby incorporated by reference.

FIELD OF THE INVENTION

The present invention pertains to emergency flotation equipment and, more particularly, to a personal flotation device having a status indicator that can be viewed by the user without removing the equipment from its storage case.

BACKGROUND OF THE INVENTION

The art of flotation equipment is filled with myriad devices for providing buoyancy to a wearer in emergency situations. One of the most compact devices is described in U.S. Pat. No. 5,738,557 for POCKET-SIZED, EMERGENCY FLOTATION DEVICE issued to Bradley A. Biesecker. That patent features a pocket-sized, portable, flotation device, including a life vest, that folds into a carrying case that is the size of a cellular phone or camera. The device can be carried in a shirt or a jacket pocket, or clipped to the wearer's waistline belt at any point about the girth. Upon activation, the flotation device inflates into a collar, which separates the flotation balloon into separate compartments or cells, each of which is substantially sealed from adjacent compartments to prevent or reduce deflation of the adjacent cells through puncture or other mishap to one of the cells.

The carrying case has a body and a detachable, arch-shaped cover, constructed so that a tether can be inserted into the cover and the device automatically activated merely by pulling the cover from the body. The user is instructed to pull or draw the cover continuously until the life vest is inflated.

As the market for personal flotation devices increases and regulations are enacted relating to the manufacture and use of such devices, more sophisticated features are also required. For example, the present invention reflects the discovery that there is a need for the storage case of such equipment to include a handle or belt loop through which the belt of the user can be inserted. Moreover, if the handle is hollow, it can receive the tether, attached to the life vest itself. The handle can be adapted to receive a separate belt worn by the user or to receive a belt integral with the storage case itself.

Also, it has been found that inflating the life vest too quickly can be awkward or even dangerous for the user. It is considered to be beneficial for the life vest to inflate relatively slowly, to allow the user to position it over his or her head before and during inflation.

The U.S. Coast Guard is in the process of requiring that a personal flotation device user be able to determine the status of the device, visually, without removing same from its storage case.

It would be advantageous to provide an emergency flotation device that can be folded into a small pack that is easily carried almost anywhere on a person.

It would also be advantageous to provide for a handle, attached to the storage case of such device, through which the belt of the user can be inserted.

It would also be advantageous to provide for the handle to be hollow, to form a loop into which the tether, attached to the life vest itself, can be threaded.

It would further be advantageous to provide a mechanism for visually determining the status of the device, without removing same from its storage case.

It would also be advantageous to provide an emergency flotation device in which the life vest inflates relatively slowly, one cell at a time, to allow the user to position same over his or her head before and during inflation.

SUMMARY OF THE INVENTION

In accordance with the present invention, there is provided a pocket-sized, portable, flotation device that folds into a storage or carrying case, which is the size of a cellular phone or camera. It can be carried upon a person in a shirt pocket or clipped to a waistline belt. The flotation device includes a life vest with a collar having separate compartments or cells, each of which is substantially sealed from adjacent compartments to prevent or reduce deflation of the adjacent cells through puncture or other mishap to one of the cells. The collar of the life vest inflates, cell by cell, allowing the user to position the vest over his or her head before or even during inflation. The carrying case has a body and a detachable, arch-shaped cover, constructed so that a tether can be inserted into the cover and the device automatically activated merely by pulling the cover from the body of the case. Moreover, the storage case includes a handle or belt loop through which the belt of the user can be inserted. The handle can be hollow, to form a loop into which the tether (attached to the life vest itself) can be threaded. The handle can be adapted to receive a separate belt worn by the user or to receive a belt integral with the storage case itself. The case of the device includes a window through which a user is able to determine the status of the device, visually, without removing same from its storage case. Alternatively, the entire storage case can be transparent to allow for visual inspection of a status indicator while the life vest is in situ.

BRIEF DESCRIPTION OF THE DRAWINGS

A complete understanding of the present invention may be obtained by reference to the accompanying drawings, when considered in conjunction with the subsequent, detailed description, in which.

DESCRIPTION OF THE PREFERRED EMBODIMENT

Generally speaking, the invention features an emergency flotation device that can be folded into a small pack that is easily carried almost anywhere on a person. The flotation device folds up like the pleats of an accordion, or is rolled and housed in a case that is the approximate size of a small camera. It can be carried upon a person in a shirt pocket or clipped to a waistline belt. The flotation device includes a life vest which inflates, cell by cell, allowing the user to position the vest over his or her head before or even during inflation. The unit's flotation capability and waterproof design are important for military personnel or civilians in, on or near water (e.g., boaters, fishermen, swimmers). The storage case includes a handle through which the belt of the user can be inserted. The handle can be hollow, to form a loop into which the tether (attached to the life vest itself) can be threaded. The case of the device includes a window through which a user is able to determine the status of the device, although the entire storage case can be transparent to allow for visual inspection of a status indicator.

Figure 1A:
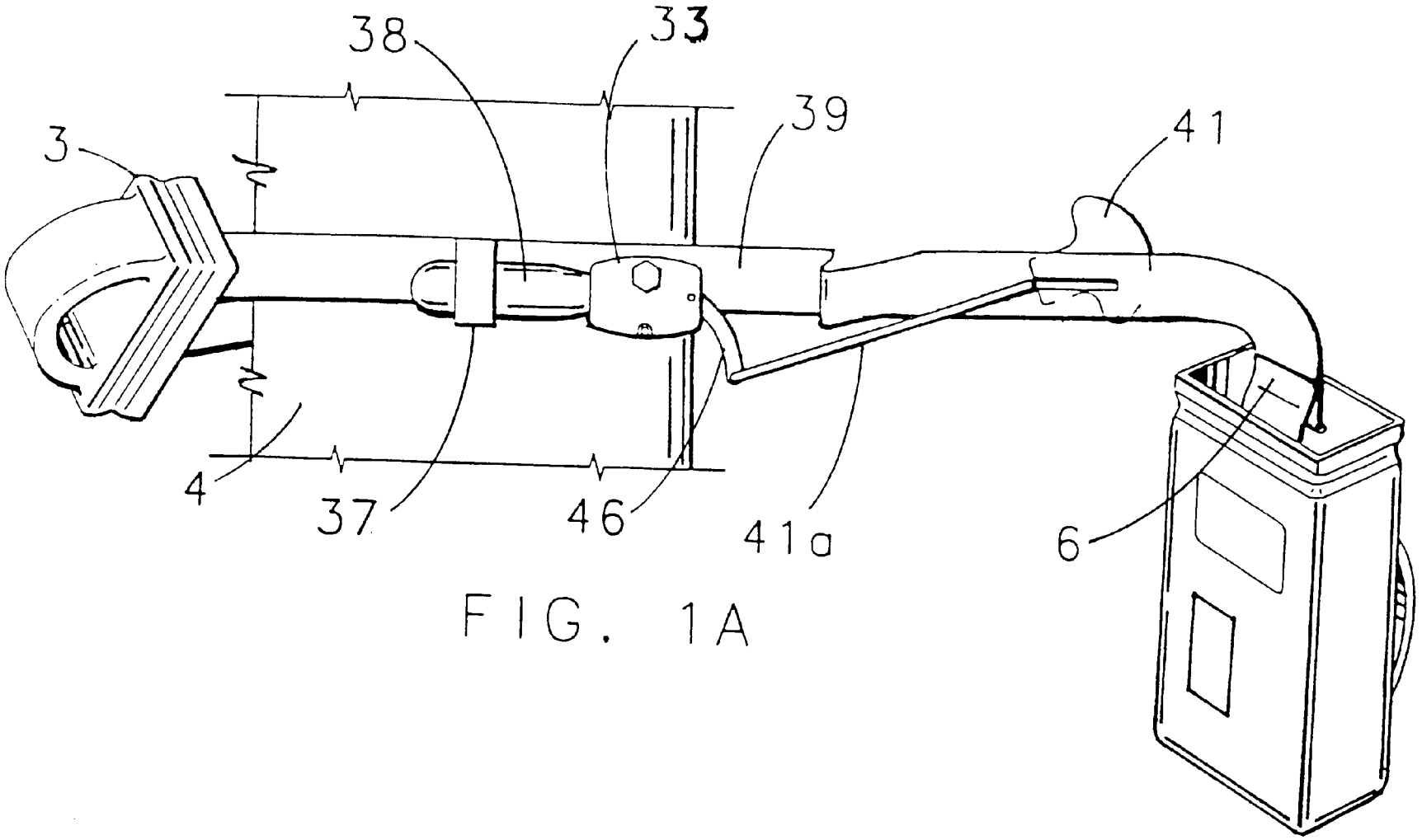
FIG. 1A depicts a perspective view of a storage and carrying case of the present invention, with the case in an open position and its components deployed, but not inflated, for ease of description.
Figure 1B:
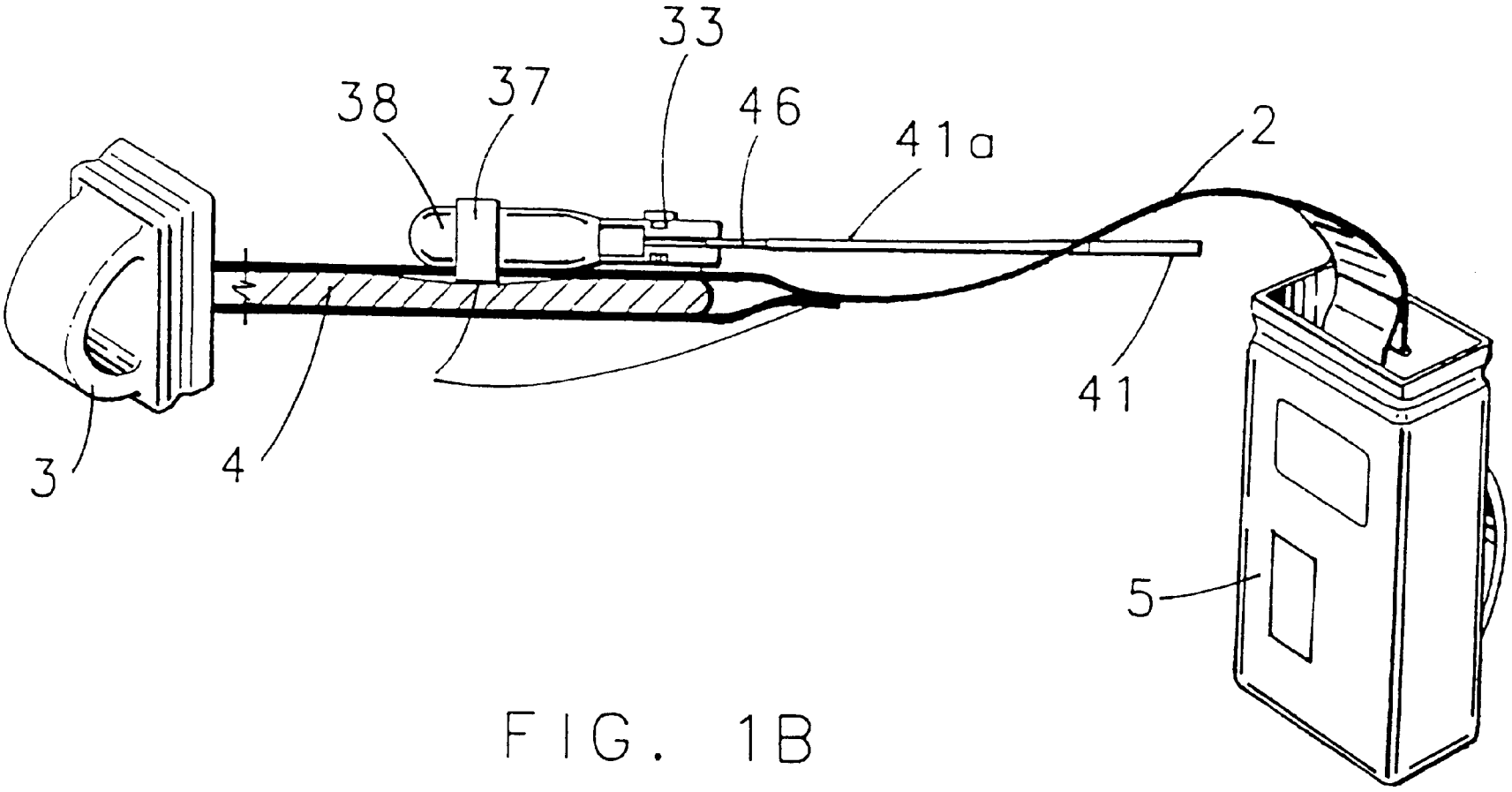
FIG. 1B depicts a perspective view of the storage and carrying case shown in FIG. 1A, and in which the components are rotated 90° relative thereto.

Now referring to FIGS. 1A and 1B, the flotation device of the present invention is shown. A storage or carrying case 5 houses all of the components of the flotation device, including a flotation collar or vest 4, when deflated. The case 5 is very small, about the size of a compact, portable camera (1.75"×3.0"×6.5"). These small dimensions allow one to carry the case 5 almost anywhere upon one's person (e.g., in a shirt pocket, or hanging from a waistline belt), as described in greater detail hereinbelow.

Figure 3:
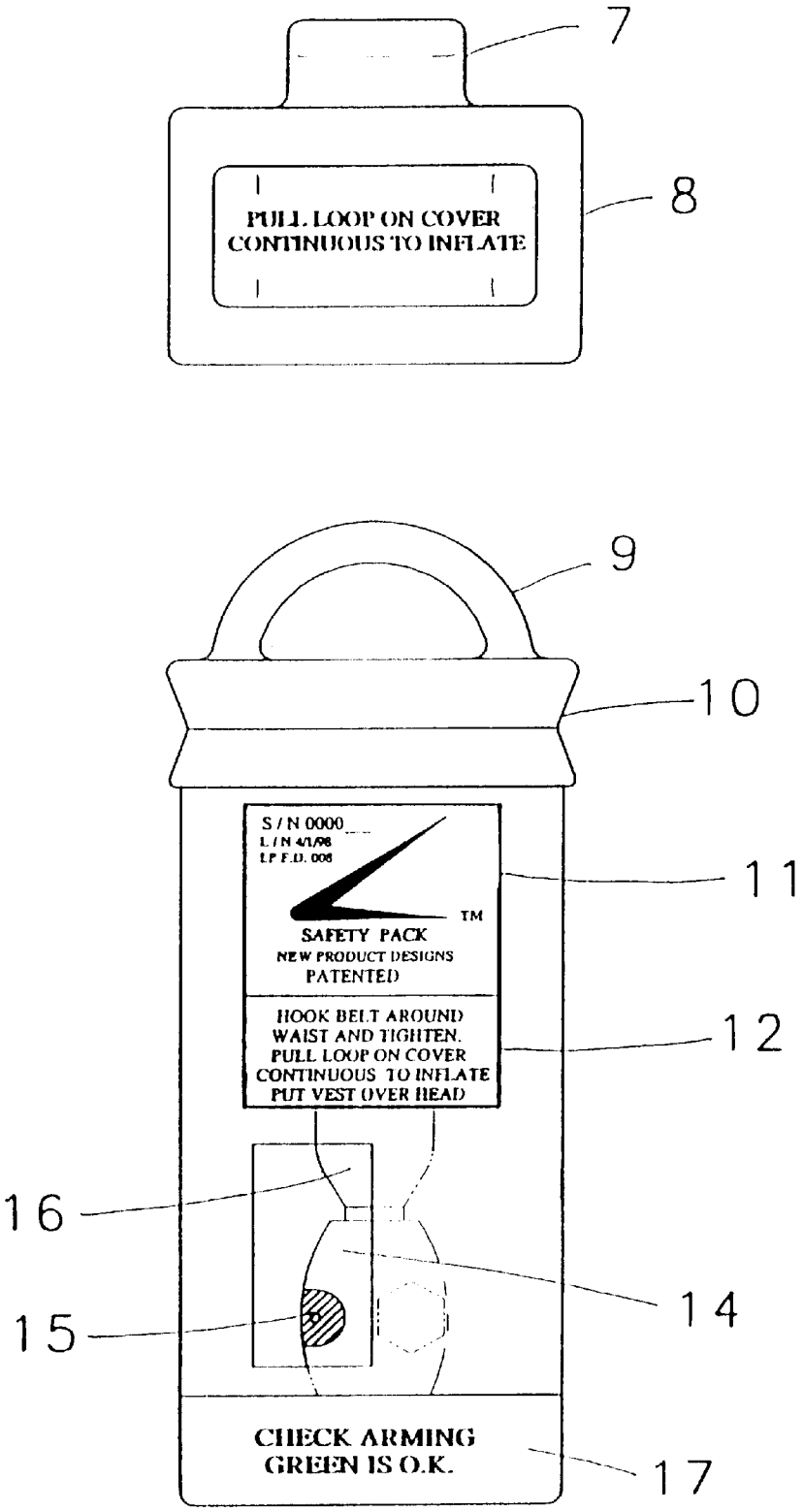
FIG. 3 depicts plan and top views of the flotation device storage and carrying case having a transparent window for viewing a status indicator.

The case 5 comprises a soft fabric or plastic body. The soft, pliable embodiment is free of any protrusion that may hinder freedom of movement for a user, not shown. The case 5 can be substantially transparent, so that the user, without disassembling the components stored and carried within the case 5, can inspect them through the case 5 itself. In another embodiment (FIG. 3), a substantially transparent portion of the case 5 or window 11 is provided to accomplish the aforementioned inspection. Construction of the window 14 is described hereinbelow with reference to FIG. 4.

A detachable, quick release lid or cover 3 fits and closes snugly over the top edges of the case 5. The soft, pliable lid 3 has a sealing lip on its four sides that close on the upper edges of the body of the case 5. When the lid 3 is being closed, the upper edge of the body of the case 5 forces the flex sealing lip open. The spring characteristic of the plastic forces the lip against the upper edges of the case 5. A soft plastic material may also be used for sealing. This seals the lid 3 to the case 5.

The lid 3 also comprises a molded finger loop or hollow arch large enough for the user to insert his or her finger and pull the lid 3 away from the body of the case 5. The lid 3 has a hollow channel formed in its arch for receiving the tether 2 connected to the flotation vest 4. Tether 2 is connected to an activator lever 46 which, when displaced, releases gas (preferably $CO_2$) stored in a gas cylinder 38 and connected to tether 2 by a fastener 37, as is well known in the art. The configuration of gas cylinder 38, fastener 37, and tether 2 is such as to prevent twisting of the manifold 33 during deployment. The flotation device is designed so that the user can draw the lid 3 away from the body of the case 5 continuously until the flotation vest 4 inflates.

Figure 2A:
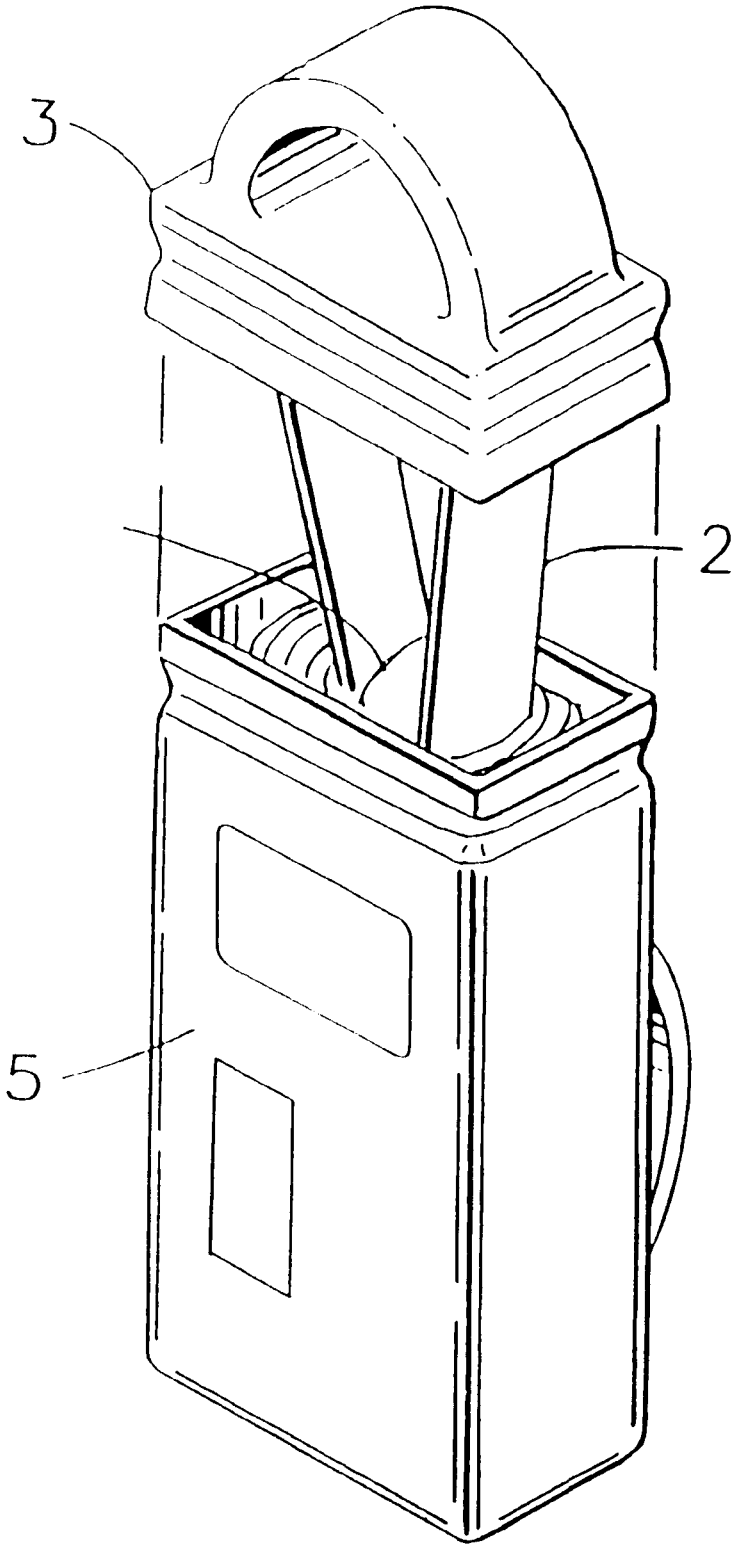
FIG. 2A is a perspective view of the storage and carrying case with cover separated therefrom.
Figure 2B:
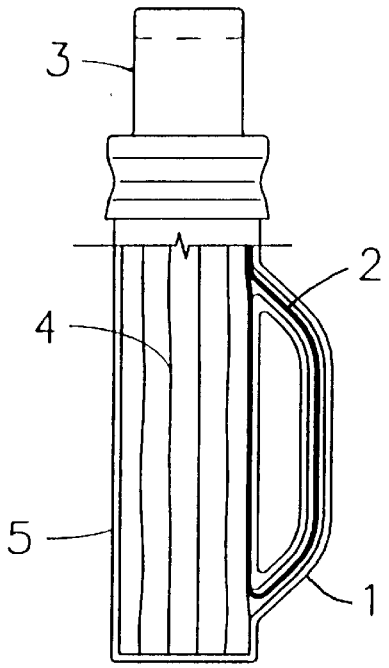
FIG. 2B shows a cross-sectional view of the device of FIG. 1A in which a tether loop is threaded through the carrying case handle.
Figure 2C:
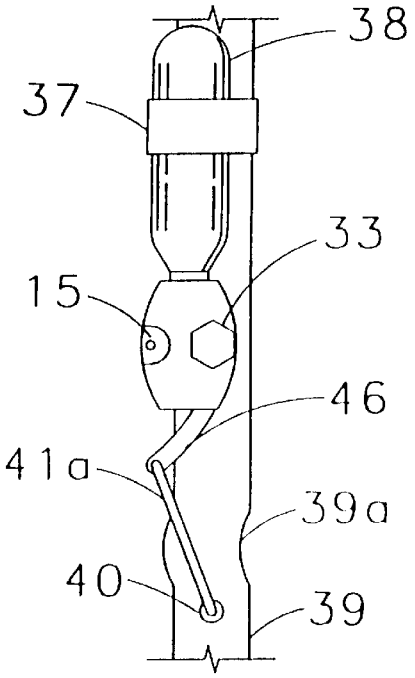
FIG. 2C is an enlarged view of the gas cartridge activation mechanism.

A belt loop or handle 1 (FIG. 2B) is formed of the same material as, and integrally with the case 5 or, alternatively, otherwise connected to the back of the body of the case 5. The belt loop 1 is also substantially hollow and adapted to receive the tether 2 affixed to the flotation collar 4. When in the deflated state, the flotation collar 4 folds (like the pleats of an accordion) or is rolled, and is easily housed within the carrying case 5, as illustrated in FIG. 2B.

Referring again to FIG. 3, through optically clear window 14 can be seen a portion of gas cylinder 16 and a status indicator 15. Status indicator 15, such as Model No. 840 AMUEP, manufactured by Halkey-Roberts Corp., indicates that the flotation device is operational. It should be understood that the storage and carrying case 5 can be optically clear, as identified by reference numeral 13, obviating the need for window 14. A manufacturer information label 11 and instructions 12 can be fastened to case 13.

Figure 4:
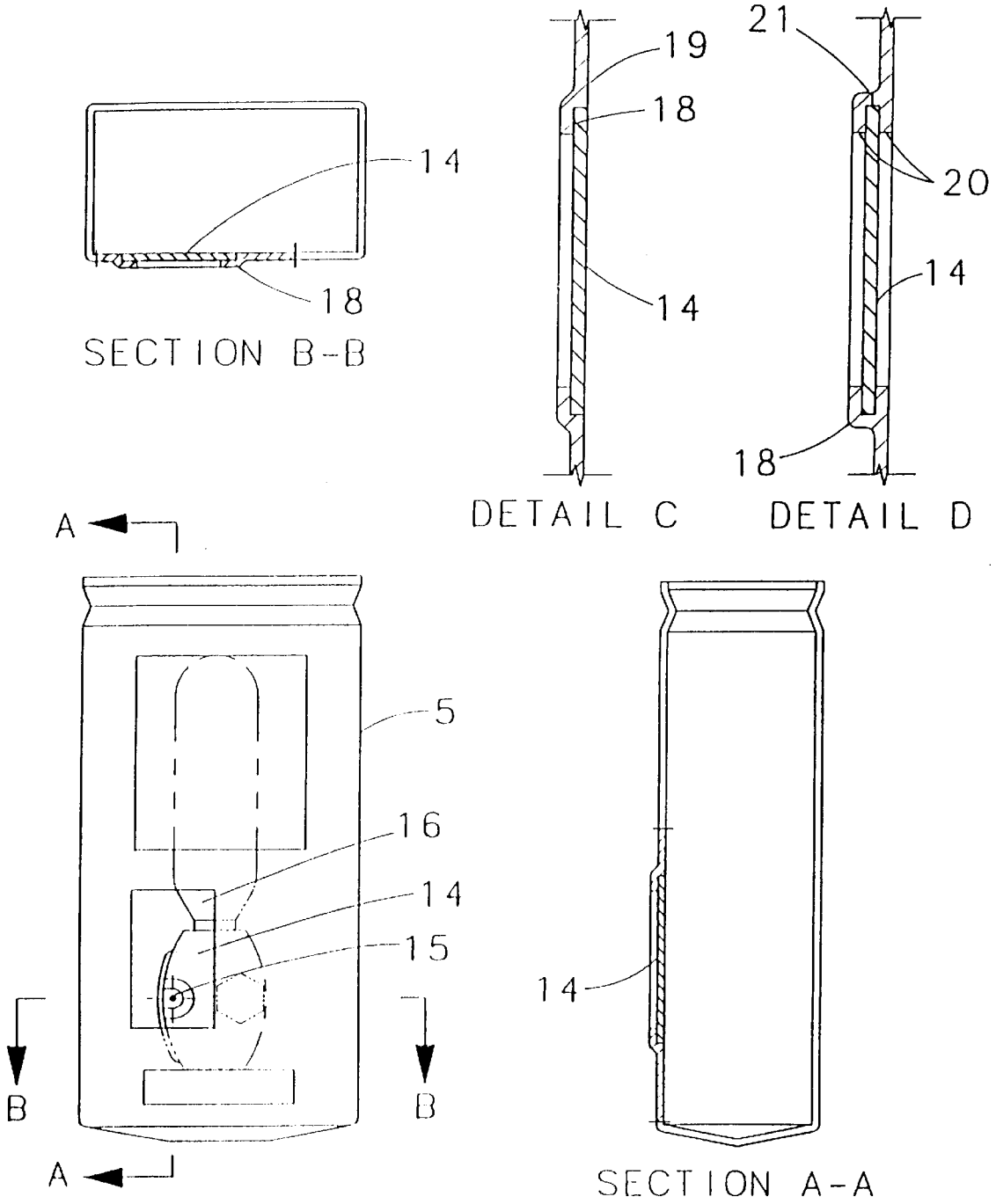
FIG. 4 shows a plan view of the device of FIG. 1A and separate sectional views taken along respective lines A—A and B—B.

Referring now also to FIG. 4, details of the optically clear window 14 and its installation are herein described. Two methods of securing are shown in DETAIL C and DETAIL D. In the former structure, window 14 is cemented, welded or sewn to the inside bezel pocket 18 in the interior of case 19. As shown in DETAIL D, a retainer pocket contains window 14 between two surfaces 20 in the bezel of case 5. A slit 21 at the top of the bezel allows an entrance for inserting window 14.

Figure 5:
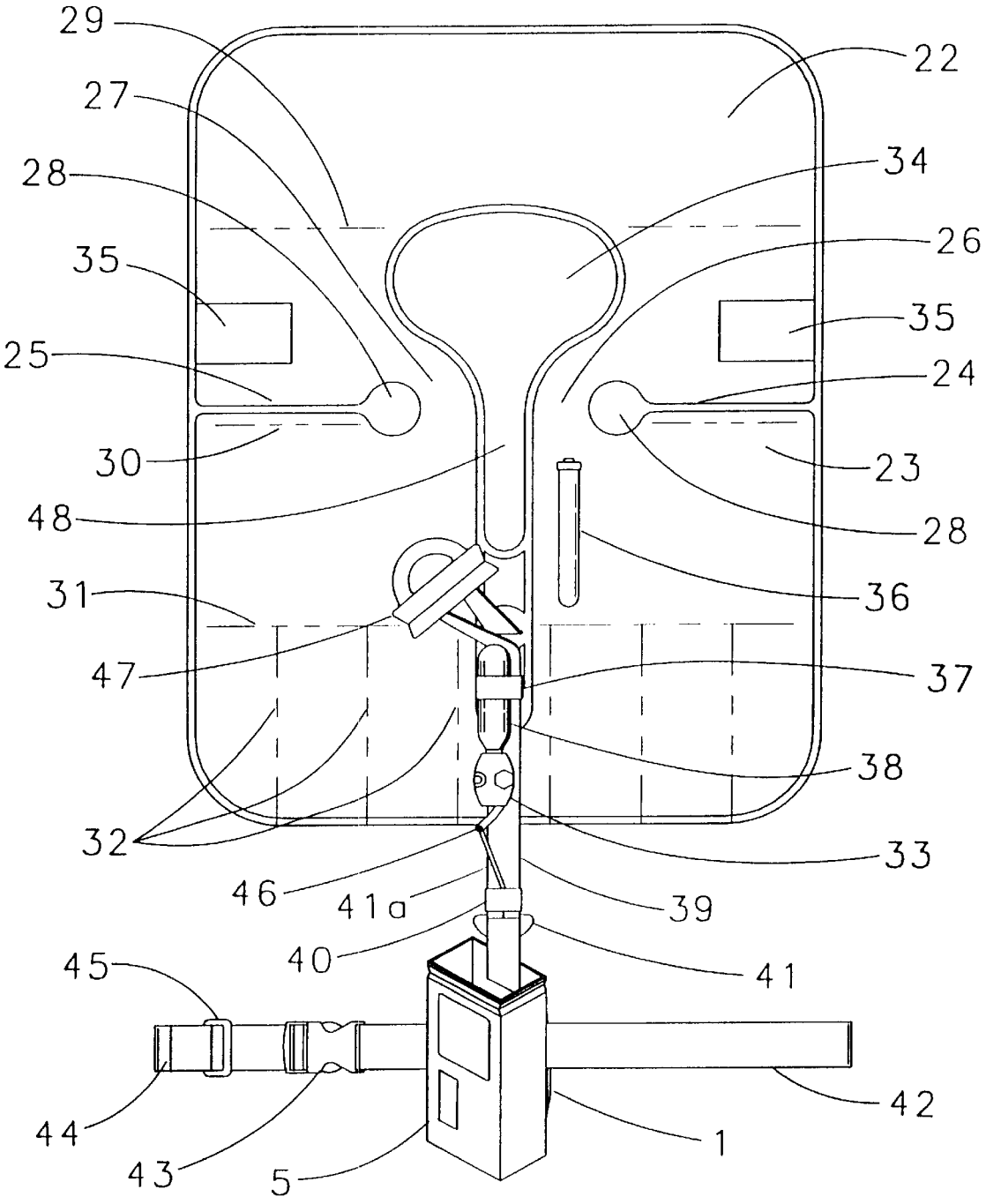
FIG. 5 illustrates an internal, flat layout development view of the flotation device depicted in FIG. 1A.

Referring now also to FIG. 5, the flotation collar 4 is shown in its expanded, inflated state. The collar 4 has a soft (but tough), lightweight, urethane plastic-coated nylon skin that inflates with pressurization of the $CO_2$ cartridge 38. The cartridge 38 is actuated by the pull of the lanyard tab 41, which in turn, via linkages 46 and 41*a*, opens valve 33 and emits carbon dioxide into the hollow body of collar 4. The collar 4 assumes a broken rectangular shape and comprises separate balloon chambers or cells 22 and 23 separated by welds or seams 24 and 25.

Orifices or passive valves 26 and 27 provide an opening for gas to enter the upper cell 22. If one cell 22 or 23 is damaged, the other cell will stay substantially inflated. Orifices 26 and 27 also provide inflated cushions under the chin and on the sides of the user (FIG. 6), in order to help prevent the flotation device from riding over the head of the user. End weld pads or seams 28 help to create two orifices and also give strength to the end welds 24 and 25.

Also attached to the flotation device are reflectors 35, a $CO_2$ fastener 37, tether 39, lanyard fastener or eyelet 40, belt 42, and buckle 43. The tightening end 44 of belt 42 and buckle 43, and the end retainer 45 are used to adjust snugness of the flotation device for the user. An oral inflator 36 is also affixed to the lower cell 22, making it easy to inflate.

To pack the flotation device into a compact package, two types of folds are required: first, a horizontal accordion fold 29, 30 and 31; then vertical folds 32 on each side of manifold 33. This tightly packs the flotation device, so as to fit into its case 5.

When the collar 4 expands, orifices 26 and 27 become substantially pinched off. This pinching prevents or reduces deflation of all of the cells 22 and 23, in the event that any one cell becomes punctured. It has been determined that an angle 49 between adjacent cells 22 and 23 helps support the user's head relative to the plane of the user's body and, in turn, to the surface of the water.

Figure 6:
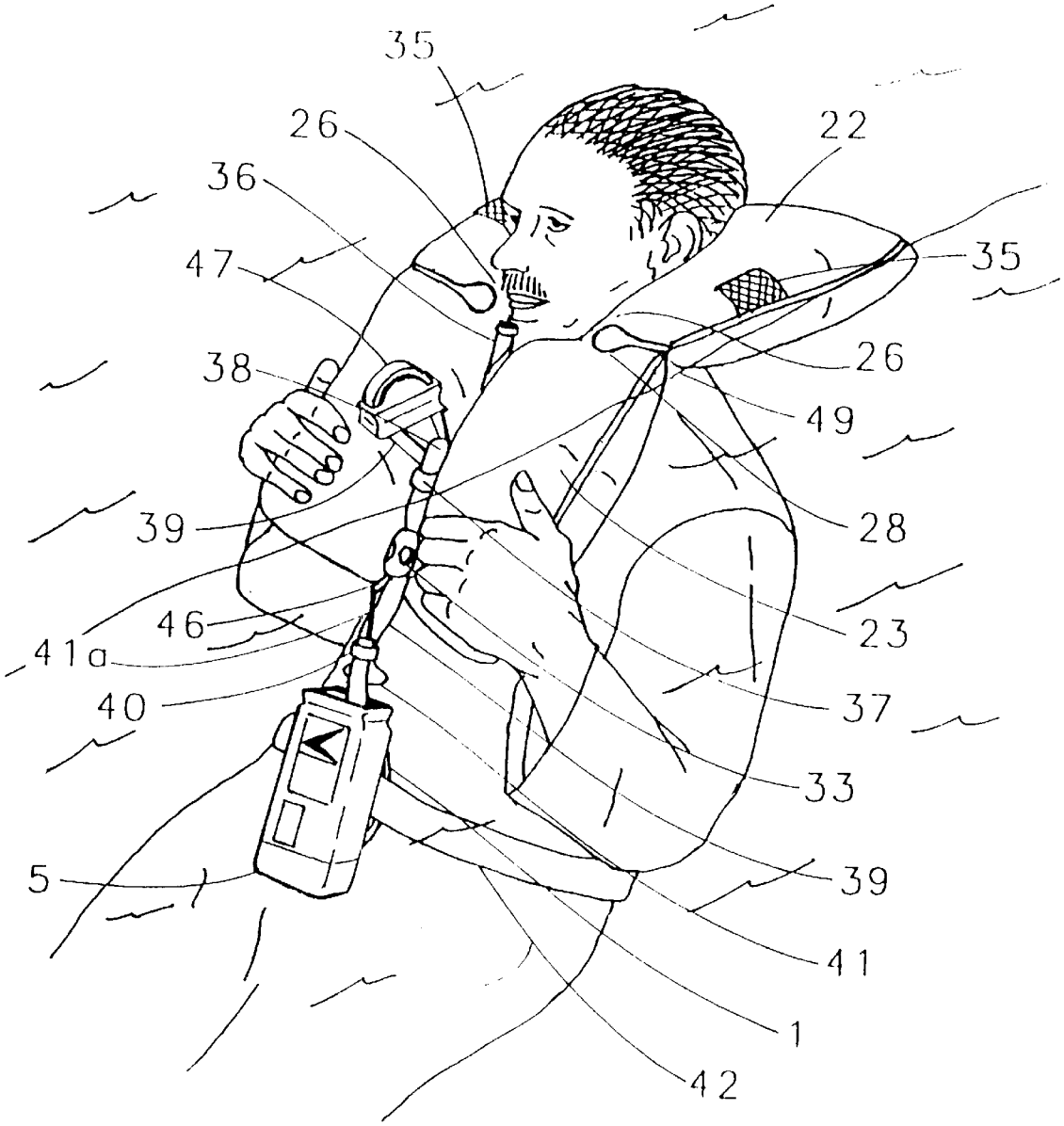
FIG. 6 is a perspective view of a user wearing the deployed flotation device shown in FIG. 1A.

Referring now also to FIG. 6, there is shown the flotation device of the present invention inflated, in situ, around a person. As can be seen from the FIGURE, the inflated flotation device can be secured around the user's waist by means of belt 42 which can be threaded through belt loop 1 or can be integral with flotation device case 5. Once the flotation device is deployed, cover or lid 47 continues to be attached to the flotation device by means of tether 39. There is no need for the user to retain or control the cover 47.

Cells 22 and 23 of the flotation device are inflated and, at the aforementioned predetermined angle 49, are positioned with respect to one another to support the user's neck and head.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A pocket-sized, portable flotation device, comprising:

a) a carrying case having:

i) a body, at least a portion thereof being substantially optically transparent and forming a viewing window, and ii) a detachable cover, said cover comprising a substantially hollow portion forming a tether loop channel in which is disposed a tether, to facilitate automatic activation of said flotation device when said cover is detached from said carrying case by a user;

b) a flotation collar folded within said carrying case in a deflated position;

c) a gas cartridge disposed inside said carrying case, and having inflatable communication with said flotation collar;

d) actuation means connected to said carrying case cover and to said gas cartridge, for actuating said gas cartridge to inflate said flotation collar; and e) means for indicating the status of said portable flotation device, said status indicating means being observable through said substantially optically transparent portion of said body of said carrying case.

2. The pocket-sized, portable flotation device in accordance with claim 1, wherein said carrying case comprises a belt loop for attaching said carrying case to a belt worn by said user.

3. The pocket-sized, portable flotation device in accordance with claim 2, wherein said belt loop comprises a substantially hollow channel for receiving said tether, so that said case, said flotation collar and said cover are attached to one another by means of said tether and attached to said user by means of a belt worn by said user.

4. The pocket-sized, portable flotation device in accordance with claim 1, wherein said gas comprises $CO_2$ stored under pressure.

5. A pocket-sized, portable flotation device, comprising:

a) a storage case having a body comprising a substantially optically transparent portion;

b) a flotation collar folded within said storage case in a deflated position;

c) a gas cartridge disposed inside said storage case, and having inflatable communication with said flotation collar;

d) a detachable cover, said cover comprising a substantially hollow arch disposed in which is a tether loop channel for receiving a tether to facilitate automatic activation of said flotation device when said cover is detached from said storage case by a user; and e) means for indicating the status of said portable flotation device, said status indicating means being observable through said substantially optically transparent portion of said storage body.

6. The pocket-sized, portable flotation device in accordance with claim 5, wherein said storage case comprises a belt loop for attaching said storage case to a belt worn by said user.

7. The pocket-sized, portable flotation device in accordance with claim 6, wherein said belt loop comprises a substantially hollow channel for receiving said tether, so that said storage case, said flotation collar and said cover are attached to one another by means of a said tether and attached to said user by means of belt worn by said user.

8. The pocket-sized, portable flotation device in accordance with claim 5, wherein said gas comprises $CO_2$ stored under pressure.

9. A pocket-sized, portable flotation device, comprising:

a) a carrying case having a body, a detachable cover having a substantially hollow portion, and a handle forming a loop with the body of said carrying case, said handle comprising a substantially hollow portion;

b) a flotation collar folded within said carrying case in a deflated position;

c) a gas cartridge disposed inside said carrying case, and having inflatable communication with said flotation collar;

d) actuation means connected to said carrying case cover and to said gas cartridge, for actuating said gas cartridge to inflate said flotation collar; and e) a belt loop for attaching said carrying case to a belt worn by said user, said belt loop comprising a substantially hollow channel for receiving a tether, so that said carrying case, said flotation collar and said cover are attached to one another by means of said tether and attached to said user by means of said belt worn thereby.

10. The pocket-sized, portable flotation device in accordance with claim 9, wherein said gas comprises $CO_2$ stored under pressure.

* * * * *